United States Patent [19]

Grihalva

[11] 4,326,746

[45] Apr. 27, 1982

[54] ROLLERSKATE CARRIER

[76] Inventor: Lawrence A. Grihalva, 10690 La Bahia, Fountain Valley, Calif. 92708

[21] Appl. No.: 110,001

[22] Filed: Jan. 7, 1980

[51] Int. Cl.[3] ..... A47F 7/16

[52] U.S. Cl. ..... 294/146; 294/148; 294/162

[58] Field of Search ..... 224/45 S, 45 M, 45 P, 224/45 Q, 50; 211/34, 37; 12/120.5; 206/315 R; 294/146, 148, 159, 162, 163, 165

[56] References Cited

U.S. PATENT DOCUMENTS

| | | | |
|---|---|---|---|
| 2,587,971 | 3/1952 | Crawford | 211/129.1 |
| 3,412,866 | 11/1968 | Binding | 224/45 S |
| 3,635,353 | 1/1972 | Matsubara | 211/34 |
| 3,721,373 | 3/1973 | Penniman | 224/45 S X |
| 3,777,956 | 12/1973 | Jung | 224/45 S |
| 3,909,718 | 9/1975 | Allsop et al. | 224/45 S |
| 4,131,196 | 12/1978 | Csutor | 206/278 |

OTHER PUBLICATIONS

"E-Z Carry Skate Tote", advertisement, Roller World, Feb. 1980.

Roadskates, newspaper advertisement.

"Skatree", carrier, Roller Skating, Dec. 1980.

*Primary Examiner*—Steven M. Pollard

*Attorney, Agent, or Firm*—Knobbe, Martens

[57] ABSTRACT

A rollerskate carrier is disclosed, including an extensible member having flexible wheel retainers which, subsequent to an initial positioning of the member, permits a pair of rollerskates to be quickly and conveniently inserted and removed from the carrier in a single manual motion. The carrier is lightweight and fully adjustable, thereby accommodating virtually all wheel sizes and rollerskate styles.

14 Claims, 4 Drawing Figures

ROLLERSKATE CARRIER

BACKGROUND OF THE INVENTION

The present invention relates generally to a carrier for rollerskates, and more particularly, to a rollerskate carrier which, subsequent to an initial preadjustment to accommodate a particular pair of rollerskates, permits the rollerskates to be repeatedly snapped into and out of the carrier in a single manual motion without any additional carrier adjustment.

Recently, there has been a dramatic increase in the popularity of rollerskating which has transcended recreational rollerskating to include amateur as well as professional speed and figure skating. As a result of this increase in popularity, there has been an increasing public demand for more sophisticated rollerskates and rollerskating-related equipment which are utilized primarily in indoor skating rink facilities. This same public demand has generated a substantial need for a carrying device adapted to permit a user to conveniently store and transport these rollerskates to and from the various rink facilities.

Although the prior art has recognized this need, existing carrier devices have either been incapable of accommodating the varying size of rollerskates, or, although accommodating differing sizes, have been extremely inconvenient in operation, often requiring the use of one or more specialized tools to adjust the carrier for the particular pair of rollerskates. Further, the adjustable prior art carriers have heretofore required a user to manually readjust the mounting mechanism during each successive insertion and removal of the skates from the carrier, thereby proving to be extremely awkward in use. Thus, there remains a need for a rollerskate carrier which is readily adjustable to accommodate varying sized rollerskates without the use of specialized tools, and once adjusted, permits successive insertion and removal of the rollerskates without further adjustment of the carrier.

SUMMARY OF THE PRESENT INVENTION

The rollerskate carrier of the present invention fills the void existing in the prior art by providing a carrier including an extensible member having flexible wheel retainers which securely mount a pair of rollerskates onto the carrier. Once the extensible member is initially adjusted to accommodate the particular size rollerskates of a user, the flexible wheel retainers permit the rollerskates to be quickly and conveniently inserted or removed from the carrier in a single manual movement without the need for further adjustment on the carrier.

Specifically, the present invention comprises a base member, having a substantially inverted T-shaped configuration, the horizontal portion of which includes suitable wheel blocks to receive the rear wheels of a pair of rollerskates and the upright or vertical portion adapted to slidingly receive one end of an extensible member. The opposite end of the extensible member includes plural flexible wheel retainers which extend outboard on opposite sides thereof, to be disposed in a plane which is substantially parallel to the horizontal portion of the base member. The wheel retainers each have a curvilinear outboard tip configuration which is sized to resiliently engage a portion of the circumference of the front wheels of each rollerskate and bias the rollerskate tightly against the horizontal portion of the base member. The vertical position of the extensible member, relative to the base member, can be adjusted by manual reciprocation of the extensible member within the upright portion of the base member and fixed by means of a wing nut assembly, thereby permitting the carrier to be rapidly adjusted for differing sized rollerskates. A handle is additionally provided adjacent the top of the extensible member to permit the carrier device to be readily grasped and transported by a user.

To initially mount a pair of rollerskates on the carrier of the present invention, the rear wheels of each of the rollerskates are placed on the horizontal portion of the base member, being disposed between the wheel blocks and the upright portion of the base member. The wing nut assembly may then be loosened and the extensible member lifted upward permitting the rollerskates to be rotated about their rear wheels into a generally vertical orientation, whereby the front wheels of each skate reside beneath the wheel retainers and contact opposite side surfaces of the extensible member. With the rollerskates in this position, the extensible member may be reciprocated downward within the upright portion of the base member until the wheel retainers engage the front wheels of the skate, thereby biasing each of the rollerskates tightly between the wheel blocks and flexible wheel retainers. The curvilinear configuration of the outboard tips of the wheel retainers conform generally to the diameter of the wheels of the rollerskates. In addition, the retainers are resilient, and are positioned to resiliently urge the rollerskates into a fixed orientation relative the extensible member. With the rollerskates positioned in this manner, the wing nut assembly may be manually tightened, thereby locking the rollerskates upon the carrier.

To remove the rollerskates after initial adjustment of the carrier, the upper end of each rollerskate is gently pulled outwardly away from the extensible member. In response to this outward force, the wheel retainers flex slightly upward, whereby the front wheels of the rollerskates may pass beneath the wheel retainers and be disengaged therefrom. The rear wheels may then simply be lifted off the base member. Alternatively, to remount the skates upon the carrier, the rear wheels may be positioned on the base member in the manner previously described, and the skates may then be pivoted to a substantially vertical orientation, to contact the outboard tip of the wheel retainers. Subsequently, the front wheels may be pressed inwardly, against the wheel retainers, with the applied horizontal force causing the wheel retainers to flex upward, permitting the passage of the wheels therebeneath. With the front wheels engaging the extensible member, the wheel retainers then spring back to their slightly stressed position, thereby securely biasing the skates against the base member.

In both the remounting and removal of the rollerskates upon the carrier of the present invention, the front wheels rotate slightly as they are forced beneath the wheel retainer, thereby decreasing the horizontal force necessary to flex the wheel retainers. Further, once the carrier is adjusted to fit a particular rollerskate size, the skates can quickly and conveniently be removed and remounted on the carrier without additional adjustment and without the requirement of special tools.

Furthermore, the carrier of the present invention can be constructed of a high impact strength, lightweight plastic material, and can be utilized to carry virtually any rollerskate size or configuration. In addition, the base member and the sides of the extensible member are advantageously sized sufficiently wide to accommodate most variations in wheel base tracks. Moreover, the surfaces in contact with the rollerskate wheels are roughened to increase frictional forces acting on the wheels and prevent accidental slippage of the rollerskates from the carrier.

DESCRIPTION OF THE DRAWINGS

These, as well as other features of the present invention, will become more apparent upon reference to the drawings, wherein.

DETAILED DESCRIPTION OF THE PREFERRED EMBODIMENT

Figure 1:
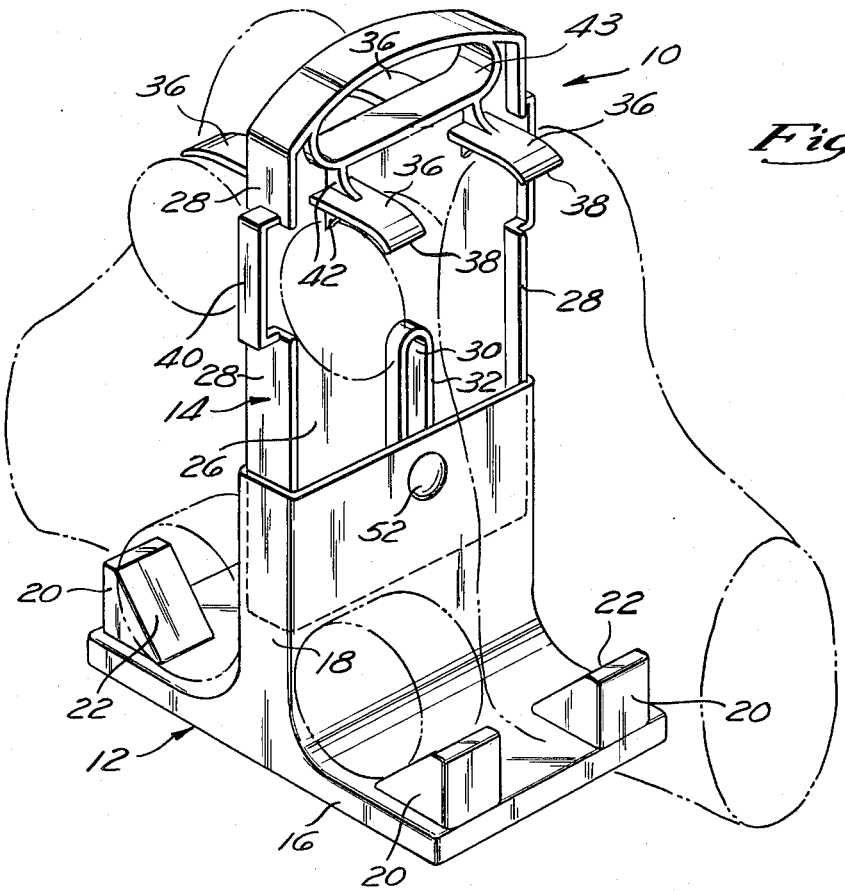
FIG. 1 is a perspective view of the rollerskate carrier of the present invention, illustrating the manner in which a pair of rollerskates is positioned thereon.

Referring to FIG. 1, there is shown a rollerskate carrier 10 of the present invention composed generally of a base member 12 and an extensible member 14, which cooperate with one another to mount a pair of rollerskates (indicated by phantom lines in FIG. 1) in a substantially vertical orientation. The base member 12 is preferably fabricated having an inverted T-shaped configuration formed by a horizontal plate portion 16 and an upright or vertical sleeve portion 18, positioned midway along the length of the plate portion 16. As is apparent from FIG. 2, the upright portion 18 segregates the base member 12 into two sections or sides which are mirror images of one another. Thus, hereinafter, the description of one section of the carrier 10 pertains equally as well to the other section.

The horizontal portion 16 of the base 12 is provided with plural wheel blocks 20, each located adjacent the distal corners of the horizontal portion 16. The wheel blocks 20 are spaced from the upright portion 18 of the base 12 and include an inclined inboard surface 22. As will become more apparent infra, the spacing of the blocks 20 from the upright portion 18, as well as their inclined surfaces 22, permit the carrier 10 to accommodate differing wheel diameter sizes and to self-register the rollerskates upon the carrier 10.

Figure 3:
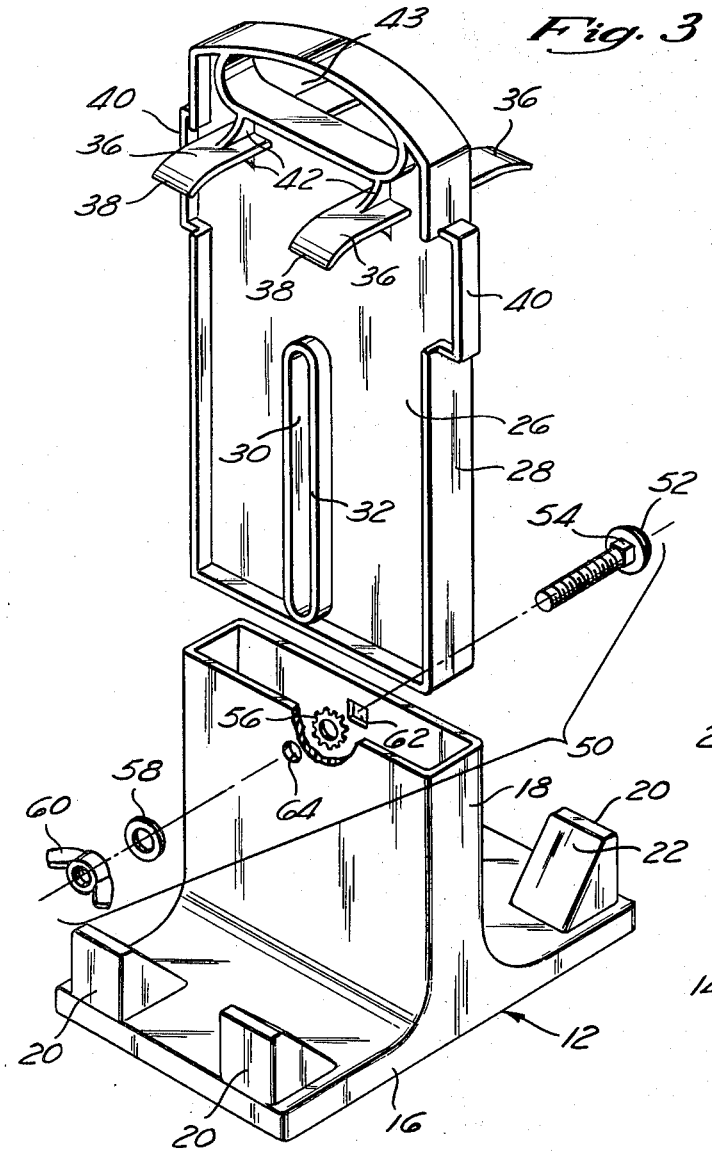
FIG. 3 is an exploded perspective view illustrating the manner of assembling the carrier of the present invention.

The upright portion or sleeve 18 of the base 12 is formed in a rectangular tube configuration, preferably being integrally formed with the horizontal portion 16 at its lower-most end. The interior dimensions of the upright portion 18 are sized to slidingly receive the lower end of the extensible member 14, thereby permitting the member 14 to be telescoped toward and away from the base 12. As best shown in FIGS. 1 and 3, the extensible member is formed in a generally rectangular configuration, having a relatively thin central web portion 26 and an increased thickness flange portion 28 extending about its periphery. An elongate vertical slot 30 is located centrally within the web 26, having raised side walls 32 extending on opposite sides thereof, having a height which is equal to or slightly less than the thickness of the peripheral flange 28.

A pair of wheel retainers 36 are integrally formed on the extensible member 14 adjacent its upper end. The retainers 36 are laterally spaced from one another and extend in a generally horizontal plane on opposite sides of the member 14 to reside over the base 12. Each of the retainers 36 includes a concave-shaped tip 38 at its outboard end. The wheel retainers 36 are strengthened at their inboard ends by plural support braces 42, which are integrally formed with the web 26 of the extensible member 14. The web 26 of the extensible member 14 preferably protrudes outward beyond the peripheral flange 28 in a localized area beneath the wheel retainers 36, forming extensions 40 adapted to accommodate unusually wide wheel tracks of particular rollerskates. An opening 43 is additionally provided adjacent the upper end of the extensible member 14 to form a handle, thereby permitting the carrier 10 to be readily grasped and transported by a user.

As best shown in FIG. 3, the base 12 and extensible member 14 are assembled together by use of a fastener assembly, designated generally by the numeral 50. The assembly 50 includes a threaded bolt 52 having a square shank portion 54, adjacent its head, a star-shaped lock washer 56, a bearing washer 58, and a wing nut 60. The bolt 52 is sized to be inserted within a pair of aligned apertures 62 and 64, centrally located adjacent the upper end of the upright portion 18 of the base 12. As shown, one of the apertures 62 is formed having a square configuration sized slightly larger than the dimensions of the square shank portion 54 of the bolt 52. With the extensible member 14 inserted to reside within the upright portion 18 of the base member 12, the bolt 52 may be inserted through the aperture 62 to extend through the elongate slot 30, formed in the extensible member 14. The lock washer 56 may then be positioned within the interior of the upright portion 18 to be aligned with the aperture 64 and abutted against the outboard edges of the raised side walls 32 of the elongate slot 30. The bolt 52 is then inserted through the lock washer 56 and aperture 64 to extend outward a short distance on the opposite side of the upright portion 18. Completely inserted, the square shank 54 portion of the bolt 52 is tightly received within the square aperture 62, formed on the upright portion 18, thereby preventing rotation of the bolt 52 and the bearing washer 58 and wing nut 60 may be manually mounted to the bolt 52 in a conventional manner. By such a fastening arrangement, it will be recognized that, with the wing nut 60 loosened, the extensible member 14 may be freely telescoped vertically within the upright portion 18. The extensible member 14 may then be selectively locked in place by tightening the wing nut 60, thereby causing the lock washer 56 to tightly grip the raised side walls 32 of the elongate slot 30.

Figure 2:
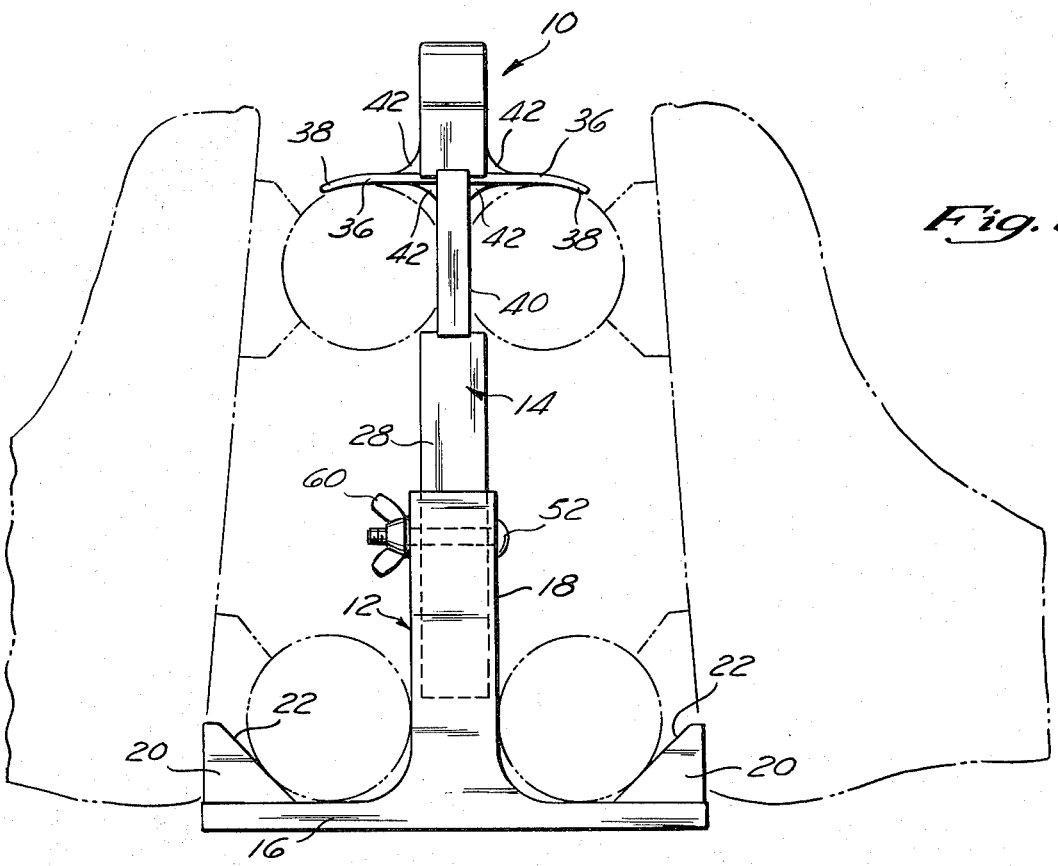
FIG. 2 is an elevation view of the carrier of FIG. 1.

While the structure defined, the initial adjustment of the rollerskate carrier 10 of the present invention, to accommodate a pair of rollerskates, may be described, with specific reference to FIGS. 1 and 2. Initially, the wing nut 60 is slightly loosened and the extensible member 14 is raised vertically to a maximum elevation. As will be recognized, the extensible member 14 is prevented from being completely removed from the base 12 during this lifting movement, by the abutment of the bolt 52 with the lower end of the elongate slot 30. The rear wheels of each of the rollerskates (indicated by the phantom lines) are then placed upon the base 12 between a respective pair of wheel blocks 20 and the upright portion 18. Due to the inclined surface 22 of the wheel blocks 20, which, in the preferred embodiment, is approximately 40 degrees from vertical, the wheels of each of the rollerskates are biased inwardly or registered against opposite sides of the upright portion 18. Further, varying diameter size wheels are readily accommodated upon the inclined surface 22 of the wheel blocks 20, with the larger or smaller wheel diameters merely being spaced at a shorter or longer distance vertically above the top surface of the horizontal portion 16 of the base 12.

Subsequently, each of the rollerskates may be pivoted about their rear wheels to assume a generally parallel orientation with the extensible member 14, whereby the front wheels of each skate contact the central web 26 of the extensible member 14. Variations in the track width of the front wheels is readily accommodated by the extending sections 40, such that the front wheels of each of the skates tangentially contact the web 26 along a single abutment line. With the rollerskates maintained in this position, the extensible member 14 is telescoped downwardly, causing the wheel retainers 36 to engage or contact the front wheels of each of the rollerskates. As is evident in FIG . 2, the length of the wheel retainers 36 is preferably formed to extend outboard a short distance beyond the vertical center line of the front wheels, such that the concave tips 38 of the retainers 36 extend about a sufficient portion of the wheel circumference to urge the wheels tightly against the web 26 of the extensible member 14. The downward pressure exerted during this lowering of the extensible member 14 should be firm enough to tightly press the front and rear wheels of the rollerskates between the base 12 and retainers 36, yet not be of such a magnitude to cause the retainers 36 to flex or distort substantially upward. Subsequently, the wing nut 60 may be manually tightened, causing the position of the extensible member 14, relative the base 12, to be fixed, and the pair of rollerskates to be maintained upon the carrier.

With the pair of rollerskates mounted to the carrier in such a manner, the carrier may be easily grasped by use of the handle opening 43 and conveniently transported by the user. To eliminate the possibility of accidental slippage of the rollerskates from the carrier during transport, the surface of the carrier at the area of contact with the skate wheels is preferably roughened to increase frictional forces. Further, due to the telescoping extensible member 14, the carrier may be readily adjusted to accept all conventional sizes and styles of rollerskates.

It is an important feature of the present invention that, once the carrier 10 is preadjusted to accommodate a particular pair of rollerskates in the manner previously described, the rollerskates may be selectively removed and remounted upon the carrier 10 without any additional adjustments. This specific feature is made possible by the construction and configuration of the wheel retainers 36 and the extensible member 14, which flex or deform in response to a moderate, manually applied horizontal force to selectively release and engage the front wheels of the rollerskates.

Figure 4:
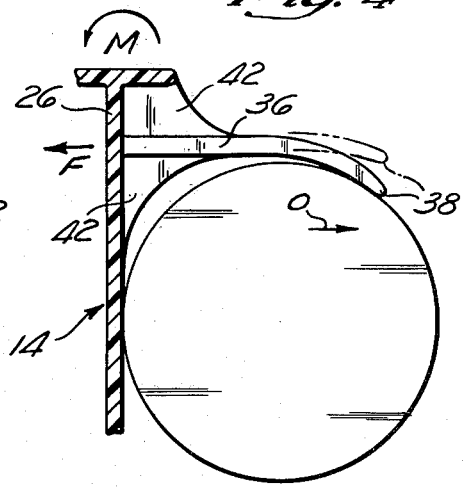
FIG. 4 is a partial cross-sectional view of a single wheel retainer of the present invention, illustrating the manner in which it flexes to permit the rapid removal and remounting of the rollerskate onto the carrier.

The detailed operation of the selective flexing of the wheel retainers 36 is schematically illustrated in FIG. 4. With the rollerskates mounted upon the carrier 10, the user may remove the rollerskates by simply applying a moderate horizontal outward force (in the direction indicated by the arrow O in FIG. 4) to the upper portion or toe of the rollerskate. Because the extensible member 14 is fixed relative to the base 12, this applied force is resisted primarily by the resiliency of the wheel retainers 36 and extensible member 14. Further, since the inboard end of the wheel retainers 36 are strengthened by the support braces 42, the wheel retainers 36 are weaker at their distan ends, i.e., at their concave tips 38.

Thus, as the magnitude of the applied horizontal force overcomes the resiliency of the retainer tips 38, the tips 38 flex or deform a short distance upwardly, as indicated by the phantom lines in FIG. 4. During this upward flexing, the front wheels of the rollerskates rotate about their respective bearing axes (not shown) and travel horizontally outward beneath the retainers 36. When the vertical center line of the wheels travel beyond the end of the tips 38, the front wheels of the rollerskates are released from the carrier 10 and the rollerskates may thus be lifted off the wheel blocks 20 and be completely removed from the carrier. As such, each of the rollerskates may be conveniently removed from the carrier 10 in a single, manual, horizontal pulling motion which causes the wheel retainers 36 to flex upward and release the rollerskates therefrom.

Alternatively, the rollerskates can be remounted upon the carrier 10 by simply placing the rear wheels of the skates upon the wheel blocks 20 and pivoting the rollerskates upward so that the front wheels contact the tips 38 of the wheel retainers 36. A moderate inward horizontal force may then be applied to the toe portion of the rollerskates (in a direction opposite to the arrow O in FIG. 4), causing the front wheels to cam against the tips 38 of the wheel retainers 36. When the magnitude of this inward horizontal force exceeds the resiliency of the tips 38, the retainer tips 38 flex or deform upwardly (as indicated by the phantom lines in FIG. 4) and permit the front wheels to rotate about their bearing axis and travel inwardly toward the extensible member 14. When the front wheels abut the web 26 of the extensible member 14 (as illustrated by the full line position in FIG. 4), the tips 38 of the wheel retainers 36 return to their unstressed or relaxed position. In this relaxed position, the tips 38 engage a portion of the circumference of the front wheels to securely bias the skates downwardly and inwardly upon the carrier 10. Therefore, as in the removal process, the rollerskates may be rapidly and conveniently remounted upon the carrier 10 in a single, inwardly directed horizontal motion.

It will be recognized that, during the removal and remounting of the rollerskates upon the carrier 10, the application of the manually applied horizontal force upon the tips 38 of the retainers 36, generates a moment force M adjacent the intersection of the wheel retainers 36 with the extensible member 14. Due to the relative thinness of the web 26 of the extensible member 14, this moment force M causes the upper portion of the extensible member 14 to flex slightly inward in the direction of the arrow F in FIG. 4. This inward flexing of the top portion of the extensible member 14 is advantageous, in that it decreases the distance by which the tips 38 of the wheel retainers 36 need flex during the remount and removal operation. As such, the wheel retainers 36 are not subjected to severe stresses which could cause structural failure or fatigue during repeated operation.

Further, it will be noted that, because the wheel retainers 36 continuously bias the rollerskates downwardly against the base 12 and inwardly against the extensible member 14, any minor dismounting force applied to the skates during transport is resisted by the wheel retainers 36 to maintain the skates upon the carrier 10 until such time as the user purposely removes them.

Thus, in summary, the present invention provides a significant improvement in rollerskate carrier devices which requires only a single, convenient adjustement to accommodate differing sizes and styles of rollerskates and wheels. Further, once initially adjusted, the rollerskates can be conveniently removed and remounted upon the carrier 10 with a single, manual snapping motion, without the need for further adjustment or use of specialized tools. Those skilled in the art will recognize that the present invention may be readily adapted to carry multiple pairs of rollerskates and include other base plate designs, without departing from the spirit of the present invention.

I claim:

1. A rollerskate carrier comprising:

a base adapted to be carried by a user;

a member mounted on said base for positioning one end of said rollerskate at a fixed location relative said base; and arcuate resilient fastener means for snapping the other end of said rollerskate onto said base, said fastener means flexing in a direction generally parallel to the longitudinal dimension of said rollerskate in response to a force on said rollerskate in a direction generally perpendicular to said dimension to releasably mount aid other end on said base.

2. The rollerskate carrier of claim 1 wherein said positioning member comprises at least one wheel block adapted to engage one wheel set of said rollerskate.

3. The rollerskate carrier of claim 2 wherein said wheel block includes an inclined registry surface to accept differing diameter sized wheel sets.

4. The rollerskate carrier of claim 1 further comprising:

means on said base for adjusting the position of said fastener means relative said positioning member to accommodate varying sizes of said rollerskate.

5. A carrier for a rollerskate and the like comprising:

a base adapted to retain one wheel set of said rollerskate;

a structural member mounted adjacent one end to said base; and means attached adjacent to the other end of said structural member for resiliently and releasably capturing the other wheel set of said rollerskate, said capturing means flexing in a direction generally parallel to the longitudinal dimension of said rollerskate in response to a force generally perpendicular to said dimension.

6. The carrier of claim 5 wherein said structural member is adjustably mounted to said base to vary the spacing between said capturing means relative said base.

7. The carrier of claim 6 wherein said capturing means comprises at least one resilient flange rigidly connected at one end to said structural member and extending outward therefrom to engage a portion of the periphery of said other wheel set.

8. The carrier of claim 7 wherein the other end of said flange includes a convex tip adapted to engage said portion of the periphery of said other wheel set.

9. The carrier of claim 8 wherein said convex tip is adapted to flex in response to said other wheel set being manually pressed thereagainst.

10. The carrier of claim 9 wherein said base includes at least one wheel block adapted to engage said one wheel set of said rollerskate.

11. The carrier of claim 10 wherein said wheel block includes an inclined upper surface to accommodate differing sized wheel diameters of said skate.

12. A carrier for a rollerskate and the like comprising:

a base adapted to retain one wheel set of said rollerskate;

a structural member mounted adjacent to one end to said base; and means attached adjacent the other end of said structural member for resiliently and releasably capturing the other wheel set of said rollerskate, said structural member being adjustably mounted to said base to vary the spacing between said capturing means relative said base, said capturing means comprising at least one resilient flange rigidly connected at one end to said structural member and extending outward therefrom to engage a portion of the periphery of said other wheel set, the other end of said flange comprising a convex tip adapted to engage said portion of the periphery of said other wheel set, said convex tip being adapted to flex in response to said other wheel set being manually pressed thereagainst.

13. The carrier of claim 12 wherein said base includes at least one wheel block adapted to engage said one wheel set of said rollerskate.

14. The carrier of claim 13 wherein said wheel block includes an inclined upper surface to accommodate differing sized wheel diameters of said skate.

* * * * *